US006623804B1

(12) United States Patent
Kawaguchi et al.

(10) Patent No.: US 6,623,804 B1
(45) Date of Patent: Sep. 23, 2003

(54) MELTING AND IMPREGNATING APPARATUS METHOD OF MANUFACTURING LINEAR COMPOSITE MATERIAL AND LINEAR COMPOSITE MATERIAL

(75) Inventors: Kenichi Kawaguchi, Shizuoka (JP); Hitoshi Ushijima, Shizuoka (JP); Takeshi Kamata, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/667,305

(22) Filed: Sep. 25, 2000

(30) Foreign Application Priority Data

Sep. 30, 1999 (JP) ..... 11-279274

(51) Int. Cl.[7] ..... B05D 1/18; B05D 1/36

(52) U.S. Cl. ..... 427/404; 427/402; 427/431; 427/434.2; 427/434.6; 427/434.7

(58) Field of Search ..... 427/430.1, 431, 427/433, 434.2, 434.6, 402, 404, 434.7

(56) References Cited

U.S. PATENT DOCUMENTS 4,010,876 A * 3/1977 Steinemann ..... 222/595
4,157,409 A * 6/1979 Levitt et al. ..... 427/299
5,730,853 A * 3/1998 Smith et al. ..... 205/210
5,736,199 A * 4/1998 Blucher ..... 427/430.1
5,897,683 A * 4/1999 Unoki et al. ..... 118/405

FOREIGN PATENT DOCUMENTS

| | | | |
|---|---|---|---|
| BE | 1003160 A5 | 12/1991 | |
| DE | 26 23 047 A1 | 11/1977 | ..... H01B/12/00 |
| EP | 0 162 542 A2 | 11/1985 | ..... C22C/1/09 |
| JP | 49-27882 | 3/1974 | |
| JP | 49-83881 | 8/1974 | |
| JP | 63-175303 | 7/1988 | ..... H01B/7/18 |
| JP | 4-334629 | 11/1992 | ..... B60M/1/30 |
| JP | 8-109422 | 4/1996 | ..... C22C/1/05 |
| JP | 8-124426 | 5/1996 | ..... H01B/7/00 |

OTHER PUBLICATIONS

Patent Abstract of Japan 08109422 Apr. 30, 1996.
Patent Abstract of Japan 08124426 May 17, 1996.

* cited by examiner

*Primary Examiner*—Michael Barr
(74) *Attorney, Agent, or Firm*—Sughrue Mion, PLLC

(57) ABSTRACT

A melting and impregnating apparatus includes an impregnating tank having an inlet sealing portion in the bottom portion thereof, an outlet sealing portion in the upper portion thereof and a drawing portion disposed between the sealing portions; a raw-material heating tank allowed to communicate with the impregnating tank through a heating passage; and pressurizing means for maintaining pressurized states of the inside portions of the impregnating tank and the pressurizing means.

2 Claims, 4 Drawing Sheets

MELTING AND IMPREGNATING APPARATUS METHOD OF MANUFACTURING LINEAR COMPOSITE MATERIAL AND LINEAR COMPOSITE MATERIAL

BACKGROUND OF INVENTION

1. Field of the Invention

The present invention relates to a linear and fiber-shape composite material, a manufacturing method therefor and a manufacturing apparatus therefor.

2. Related art

A linear or fiber-shape composite material (hereinafter collectively called as a "linear composite material") has a shape which permits the function of a core material, which is a fiber material, a linear material, a fiber material bundle or a linear material bundle (hereinafter collectively called a "linear material") to maximally be exhibited. Therefore, the linear composite material is widely used as a material of construction, an aerospace field and so forth.

The linear composite material incorporates a core material constituted by a fiber bundle material of organic fibers or inorganic fibers or core material bundle, such as a metal fiber bundle. Moreover, the linear composite material incorporates a matrix which is resin, metal or the like. If necessary, a flame retardance modifier, a wear resistance modifier, a pigment or another filler is added.

To enable the original performance of the linear composite material to completely be exhibited, complete contact is required between each fiber for constituting the matrix and the core material and the linear material to prevent formation of any void (a portion which is defective in impregnation with the matrix).

When the linear or fiber-shape composite material is continuously manufactured, a large number of voids are undesirably formed or the core material is frequently damaged. As an alternative to this, the matrices are excessively increased. Therefore, a composite material having satisfactory performance cannot easily be obtained.

For example, FIG. 3 shows an extruder for use to coat an electric fiber which is one of the composite materials. FIG. 3(*a*) is a side view, and FIG. 3(*b*) is a front view. In FIG. 3(*b*), a linear material is continuously introduced so as to be coated with matrices (which are usually made of resin). Then, a dice is used to control the amount of the matrix to a required amount so as to continuously be extracted. The foregoing so-called "fiber coating method" suffers from insufficient contact between the matrix and the linear material. Thus, formation of a void cannot be prevented.

In a case of a composite material which incorporates the core material constituted by carbon fibers (long fibers), long polyimide fibers or the like, a dipping method is known, the model of which is shown in FIG. 4. The foregoing method is performed such that a linear material is continuously dipped in a matrix-material tank. Then, a pulley or the like is used to turn the direction so as to upwards pull the linear material. Also the foregoing method suffers from incomplete contact between the matrix and the linear material. In particular, the foregoing problem becomes conspicuous in a case where the fiber material bundle is employed as the linear material. Since voids are formed and the direction is turned by the pulley portion and the like, the core material constituted by the linear material easily encounters a defect, such as breakage or damage.

SUMMARY OF INVENTION

An object of the present invention is to provide a linear composite material which is capable of solving the problem experienced with the conventional technique, that is, which is capable of preventing damage and breakage of the core material thereof, which is free from any defect, such as voids, caused from defective impregnation and which enables the original performance to satisfactorily be exhibited.

To solve the foregoing problems, a melting and impregnating apparatus according to a first aspect of the present invention is a melting and impregnating apparatus comprising: an impregnating tank having an inlet sealing portion in the bottom portion thereof, an outlet sealing portion in the upper portion thereof and a drawing portion disposed between the sealing portions; a raw-material heating tank allowed to communicate with the impregnating tank through a heating passage; and pressurizing means for maintaining pressurized states of the inside portions of the impregnating tank and the pressurizing means.

According to a second aspect of the present invention, a melting and impregnating apparatus has a structure according to the first aspect of the present invention, wherein metal coating means is provided adjacent to the outlet sealing portion.

According to a third aspect of the present invention, a method of manufacturing a linear composite material according to the present invention comprises the steps of: continuously introducing a linear material which serves as a core material through an inlet sealing portion formed in the bottom portion of an impregnating tank containing a molten material for a matrix in a pressurized inside portion thereof; drawing the linear material impregnated with the material for the matrix in a drawing portion formed adjacent to the liquid level of the molten material for the matrix; and continuously extracting the linear material impregnated with the material for the matrix through an outlet sealing portion formed in the impregnating tank.

According to a fourth aspect of the present invention, a method of manufacturing a linear composite material has a structure according to the third aspect of the present invention, wherein the surface of the linear composite material obtained by the method of manufacturing a linear composite material is coated with metal by metal coating means disposed adjacent to the outlet sealing portion of the impregnating tank.

According to a fifth aspect of the present invention, a linear composite material according to the present invention comprises: reinforcing fibers; and metal matrices, wherein the outer surface of the linear composite material is coated with a metal coating film.

DETAILED DESCRIPTION OF PREFERRED EMBODIMENTS

Figure 1:
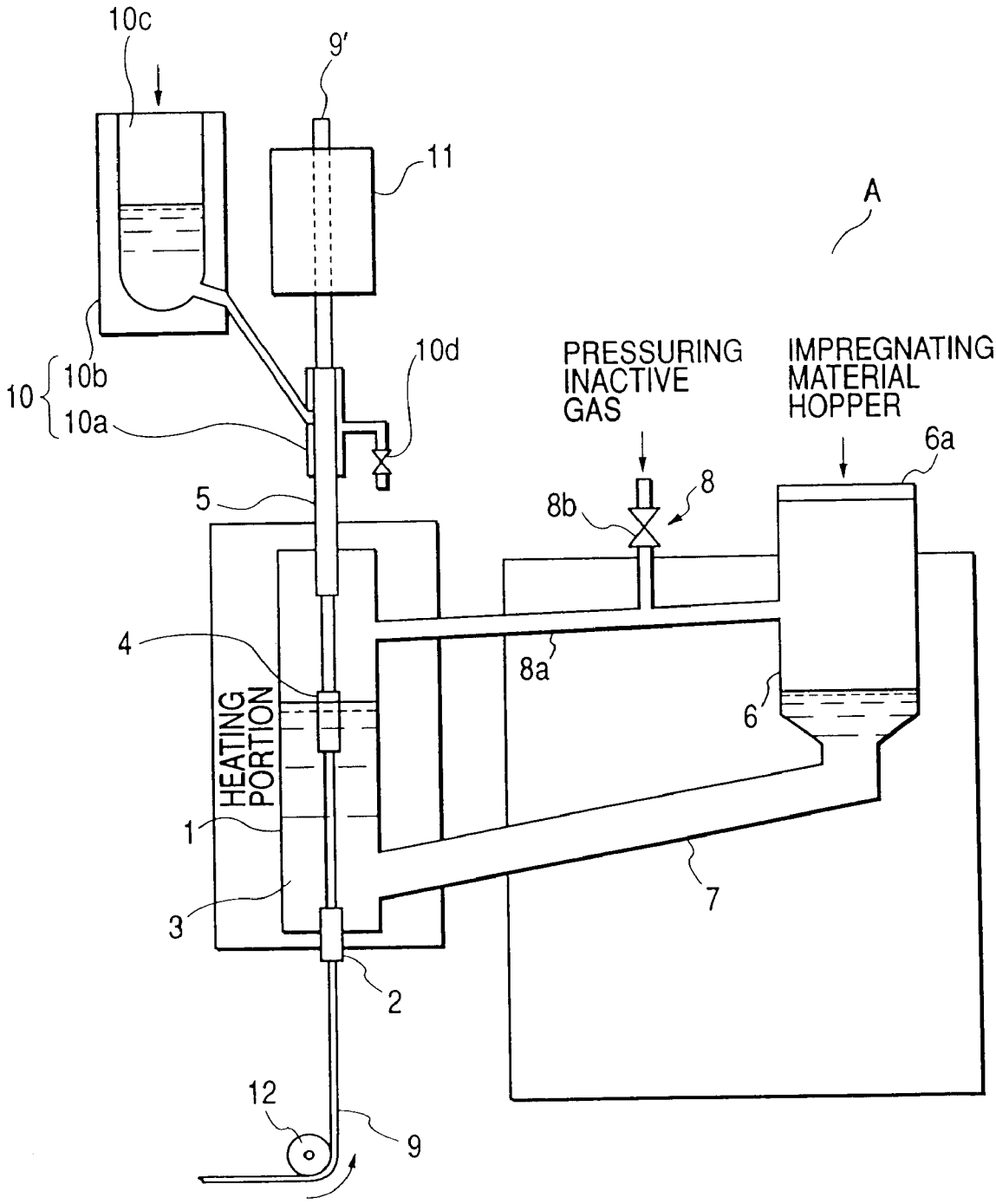
FIG. 1 is a diagram showing a melting and impregnating apparatus A according to the present invention.

A melting and impregnating apparatus according to the present invention comprises: an impregnating tank having an inlet sealing portion in the bottom portion thereof, an outlet sealing portion in the upper portion thereof and a drawing portion disposed between the sealing portions; a raw-material heating tank allowed to communicated with the impregnating tank through a heating passage; and pressurizing means for maintaining pressurized states of the inside portions of the impregnating tank and the pressurizing means.

As a result of the foregoing structure, a method of manufacturing a linear composite material according to the present invention can continuously and stably be performed for a long time. The method comprises the steps of: continuously introducing a linear material which serves as a core material through an inlet sealing portion formed in the bottom portion of an impregnating tank containing a molten material for a matrix in a pressurized inside portion thereof; drawing the linear material impregnated with the material for the matrix in a drawing portion formed adjacent to the liquid level of the molten material for the matrix; and continuously extracting the linear material impregnated with the material for the matrix through an outlet sealing portion formed in the impregnating tank.

In the apparatus for melting and impregnating the composite material, the material for the matrix is melted or softened in the tank for heating the raw material so as to be fluidized and continuously supplied to the impregnating tank. The liquid level of the molten matrix component in the impregnating tank dose not considerably be changed. Moreover, the pressurized states of the inside portion of the impregnating tank and the tank for heating the raw material are maintained. Therefore, excellent linear composite material free from any void can continuously be obtained for a long time.

The drawing portion is disposed between the inlet sealing portion and the outlet sealing portion. The drawing portion is disposed at a position lower than the ceiling of the impregnating tank. The diameter of the linear composite material is controlled by the drawing portion. Moreover, the impregnating tank is applied with pressure as described above. Therefore, formation of a void which is easily formed in the inside portion can be prevented. Simultaneously, contact between the core material and the matrix component are enhanced so that impregnation is completely performed. Moreover, the production rate (the speed of the linear material which is supplied into the impregnating tank) can be raised. Hence it follows that the productivity can be improved.

Therefore, the liquid level of the molten matrix component in the impregnating tank must be lower than the upper portion of the drawing portion. Moreover, the foregoing liquid level must sufficiently be high. Since considerable change in the liquid level of the matrix is inhibited owing to the foregoing structure, stable production can be continued for a long time. In the space formed into a liquid level shape of the material for the matrix, the matrix component pulled up from the liquid level of the material for the matrix is cooled. Thus, solidification of the matrix component is started.

It is preferable that the drawing portion is formed on a straight line formed by the inlet sealing portion and the outlet sealing portion of the impregnating tank. When the drawing portion is formed at the foregoing position, deviation of the core material of the linear composite material in a product state does not occur. If the linear material is a fine material, such as a fiber material bundle, the linear material cannot be damaged. As a result, a linear composite material having ideal performance can be formed.

Usually, the drawing portion has an orifice shape. The inlet sealing portion and the outlet sealing portion may be a usual sealing method, for example, so-called orifice seal or so-called labyrinth seal. From a viewpoint of the spirit of the present invention, a sealing method with which the linear material is bent cannot be employed. In usual, the orifice seal is employed.

The inlet sealing portion is provided for the bottom portion of the impregnating tank. When the apparatus is operated, the linear material which is the core material is continuously supplied at adequate speed from the inlet sealing portion. As a result, leakage of the material for the matrix in the impregnating tank through the inlet sealing portion can be prevented when the inlet sealing portion has the orifice shape.

It is preferable that the inner diameter of the orifice is determined such that the minimum inner diameter of the inlet sealing portion is substantially the same as the outer diameter of the supplied linear material or slightly larger than the same. It is preferable that the minimum inner diameter of the outlet sealing portion is slightly larger than the outer diameter of the linear composite material which is obtained as a product.

It is preferable that the drawing portion is employed to be adaptable to the type of the matrix. That is, when the matrix is constituted by resin, a drawing portion is employed which has a structure similar to that of a dice which is used to manufacture an electric fiber. When metal or an alloy is used as the matrix, a drawing portion having a relatively long structure is employed.

There is a necessity that the raw-material heating tank can be heated to a temperature at which the material for the matrix has sufficient fluidity. Moreover, the raw-material heating tank must be allowed to communicate with the impregnating tank through the heating passage.

On the other hand, there is a necessity that the heating passage can be heated to a temperature at which the material for the matrix has sufficient fluidity. Moreover, the heating passage must be connected to a position lower than the liquid level of the molten material for the matrix in the impregnating tank.

Since the inside portions of the impregnating tank and the raw-material heating tank are applied with pressures, the material for the matrix and the linear material are brought into ideal contact with each other. As a result, occurrence of a defect, such as a void, of the obtained linear composite material can be prevented. The application of the pressure is performed by using a gas of nitrogen or air. The material for the matrix is in a molten state in the present invention. If there is apprehension that a problem arises owing to a reaction with oxygen in the air, a gas which does not react with the molten material for the matrix is used to apply the pressure. The gas is, for example, a rare gas which is, for example, an argon gas which is an inactive gas, or a nitrogen gas.

The pressurizing gas leaks through the outlet sealing portion in the upper portion of the impregnating tank at a low leakage rate. It is preferable that the pressurizing gas is supplied from, for example, a cylinder having a large capacity or a compressing pump to enable the pressurizing gas to continuously or intermittently be supplied. Since the pressure in the impregnating tank is maintained as described above, the excellent linear composite material free from any guide can be obtained.

The material for the matrix according to the present invention may arbitrarily be employed if the employed material for the matrix is melted when the material is heat and the material is solidified when the material is cooled. That is, the material for the matrix may be thermoplastic resin, metal or an alloy. The employed material is heated to a temperature required to melt the material. Note that the temperature must be a level at which the material for the matrix is not decomposed. If necessary, each of the impregnating tank and the raw-material heating tank may be provided with a means for stirring or circulating the material for the matrix so as to maintain a uniform composition.

The linear material for constituting the core material (the reinforcing material) of the composite material according to the present invention may be any one of the following materials: inorganic fibers (ceramic fibers), such as graphite fibers, carbon fibers, silicon carbide fibers, silica fibers, boron fibers or alumina fibers; or synthetic resin, such as polyimde, nylon or polyester. If necessary, a linear material constituted by chemical resin or natural fiber, such as rayon or cotton yarns, or metal fibers or a metal fiber made of stainless steel, copper or steel may be employed. The present invention enables the material for the matrix to reliably be introduced into the linear material. Therefore, a twisted material or a braided rope may be employed which is obtained by twining or knitting the linear material.

The linear material must be made of a material which is selected such that decomposition, melting and deterioration do not occur at the temperature at which the matrix is melted.

The core material is not limited to the material capable of improving the mechanical characteristics, such as the tensile strength, bending resistance, a bending characteristic and wear resistance. Moreover, a material is selected which is capable of improving the characteristics including the electric characteristics, the electromagnetic characteristics, the thermal characteristics (the heat conductivity) and the like.

The metal coating means may be provided for a position adjacent to the outlet sealing portion of the impregnating tank. That is, the metal coating means is provided for the position above the outlet sealing portion so that the linear composite material obtained by the method of manufacturing the linear composite material by the above-mentioned melting and impregnating method is coated with the metal material.

The above-mentioned apparatus is operated by using the metal material as the material for the matrix so that the linear composite material incorporating the reinforcing fibers and the metal matrix and having the outer surface coated with the metal coating is obtained. The foregoing coating improves the durability, electric conductivity, heat conductivity, wear resistance and the hardness.

The metal must be a metal having a melting point which is lower than that of the material for the matrix. For example, copper, aluminum, iron, tin, lead, silver, magnesium or their alloy may be employed.

The metal coating means may be an impregnation plating apparatus arranged to bring molten metal into contact with the surface of the linear composite material continuously discharged from the impregnating tank. Note that the melting point of the metal material with which coating is performed by the metal coating means must be not higher than the melting point of the material for the matrix.

The linear composite material incorporating the reinforcing fibers and the matrix and having the outer surface coated with the metal coating exhibits satisfactory productivity as distinct from a pre-form fiber incorporating the core line impregnated with a molten material. When a plurality of the foregoing linear composite materials are twisted, a cross section significantly close to a complete round.can be realized. As a result, when the composite fiber coating with metal is employed as, for example, a transmission line, excellent characteristics can be obtained which include high strength, high elasticity, a high thermal conductivity and a low coefficient of linear expansion.

When the material for the matrix is made of the metal material, further provision of a metal layer on the surface of the material for the matrix enables the weather resistance and wear resistance to be improved. If the material for the matrix is made of a metal material of a type which can easily be corroded or oxidized, metal (including metal with which passivity can easily be formed) which cannot easily be corroded is applied so that the corrosion of the overall body is prevented.

When the material for the matrix extracted from the outlet sealing portion of the impregnating tank for use in the method of manufacturing the composite material is forcibly cooled, a composite material maintaining a required matrix phase can be obtained in a case where the matrix is a so-called "polymer alloy" composed of metal or a plurality or resin components.

Also the linear composite material having the outer surface coated with the metal coating by the metal coating means is forcibly cooled immediately after the metal coating has been formed so that the phase of the coated metal is maintained.

A cooling means for use in the foregoing cooling operation may be liquid nitrogen. As an alternative to this, a usual cooling means may be employed which includes an air cooling means, a water cooling means, a cooling means, a refrigerating apparatus and a Peltier device. The cooling means is disposed at a position on the extension line of a straight line which connects the inlet sealing portion and the outlet sealing portion to each other. In the foregoing case, undesirable deterioration in the performance of the obtained composite material can be prevented.

An example of the method of manufacturing the linear composite material will specifically be described with reference to the drawings.

FIG. 1 shows a melting and impregnating apparatus A according to the present invention.

An inlet sealing portion 2 is formed in the bottom portion of an impregnating tank 1. The impregnating tank 1 contains a molten material 3 for the matrix. A drawing portion 4 comprising a dice is disposed at the position of the liquid level of the molten material 3 for the matrix such that a portion of the drawing portion 4 is higher than the liquid level of the material 3 for the matrix. Moreover, an outlet sealing portion 5 is disposed on a straight line connecting the inlet sealing portion 2 and the drawing portion 4 to each other. Note that a sufficiently large space is formed above the drawing portion 4.

The impregnating tank 1 and the raw-material heating tank 6 are allowed to communicate with each other through a heating passage 7*a*. The heating passage 7*a* is connected to the impregnating tank 1 at a position lower than the liquid level of the material 3 for the matrix.

When a cover 6*a* capable of hermetically closing the raw-material heating tank 6 is removed, the material for the matrix can be introduced through an inlet opening for introducing the raw material for use in the impregnating operation. The impregnating tank 1, the raw-material heating tank 6 and the heating passage 7 can be heated by heaters (not shown). Thus, the inside portions can be maintained at temperatures not lower than the melting point of the material for the matrix.

A gas pipe 8*a* is connected to the impregnating tank 1 and the raw-material heating tank 6. The inside portions of the impregnating tank 1 and the raw-material heating tank 6 are applied with pressures by a pressurizing means 8 incorporating a pressurizing valve 8*b* and the gas pipe 8*a*. Note the pressuring gas is a gas which is inactive with respect to the molten material for the matrix.

A pipe and valves (not shown) connected to a vacuum line for substituting the internal gas are provided for the impregnating tank 1 and the raw-material heating tank 6. Thus, substitution for the internal atmosphere can easily be performed.

The pressure of the pressurizing gas may be about 50 $kg/cm^2$ or lower. Since the linear material 9 is continuously supplied through the inlet sealing portion 2 and the inlet sealing portion 2 has a sufficiently small diameter, leakage of the molten material for the matrix in the impregnating tank through the inlet sealing portion 2 can be prevented.

Since the outlet sealing portion 5 is the orifice seal, leakage of the gas in the impregnating tank through the outlet sealing portion 5 can be reduced. Moreover, a sufficiently large quantity of the gas is supplied from the pressurizing means 8. Therefore, the internal pressure can be maintained.

A metal coating means 10 is disposed adjacent to the outlet sealing portion 5 of the impregnating tank of the apparatus according to the present invention. In this embodiment, the metal coating means 10 is disposed in contact with the outlet sealing portion 5. The metal coating means 10 brings the molten metal into contact with the surface of the linear composite material continuously discharged from the impregnating tank so that the surface of the linear composite material is coated with the metal. The metal coating means 10 incorporates a coating furnace 10*a* and a heating portion 10*b* for supplying the molten metal to the coating furnace 10*a*.

The metal for coating injected into the heating portion 10*b* through an inlet opening 10*c* for injecting the coating material is heated and melted by a heater (not shown) provided for the heating portion 10*b*. Then, the metal for coating is supplied into the coating furnace 10*a*. Thus, the surface of the linear composite material continuously discharged through the outlet sealing portion 5 is coated with the metal for coating.

When the metal coating is not required or when the type of the metal is changed, the molten metal in the coating furnace 10*a* and the heating portion 10*b* is removed through a drain valve 10*d* provided for the coating furnace.

The linear composite material discharged through the outlet sealing portion 5 and coated with the coating metal by the metal coating means 10, if necessary, is forcibly cooled by the cooling unit 11 which uses liquid nitrogen. The cooling unit 11 is disposed above the outlet sealing portion 5 at a position on the extension line of the straight line which connects the inlet sealing portion 2 and the outlet sealing portion 5 to each other.

The foregoing apparatus is operated such that the direction of the linear material 9 which serves as the core material is changed by a pulley 12 from the right-hand position in the drawing to the upward direction. Then, the linear material 9 is, through the inlet sealing portion 2, continuously introduced into the molten material 3 for the matrix in the impregnating tank 1. The drawing portion 4 is used to perform control such that an appropriate quantity of the contained matrix and a required diameter are realized. Then, the material is continuously extracted to the outside of the impregnating tank 1 through the outlet sealing portion 5. If necessary, the metal coating means 10 is operated to coat the surface of the material with the metal coating. Then, the cooling unit 11 is operated to forcibly cool the material so that a linear composite material 9' according to the present invention is continuously obtained.

Figure 2A:
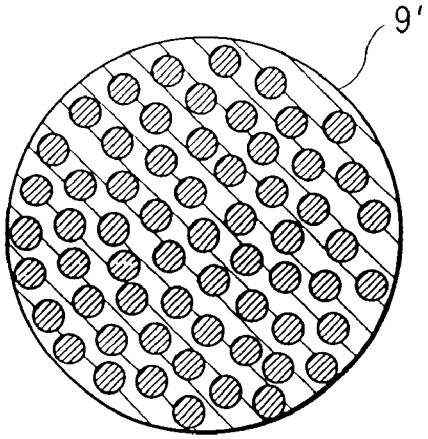
FIG. 2 is a cross sectional view showing a model of a linear composite material according to the present invention, in which FIG. 2(*a*) is a cross sectional view showing a model of a linear composite material incorporating a matrix, which is not coated with a metal coating, and a linear material which is a core material and FIG. 2(*b*) is a cross sectional view showing a model of a linear composite material incorporating a matrix having the surface coated with the metal coating and a linear material which is the core material.
Figure 2B:
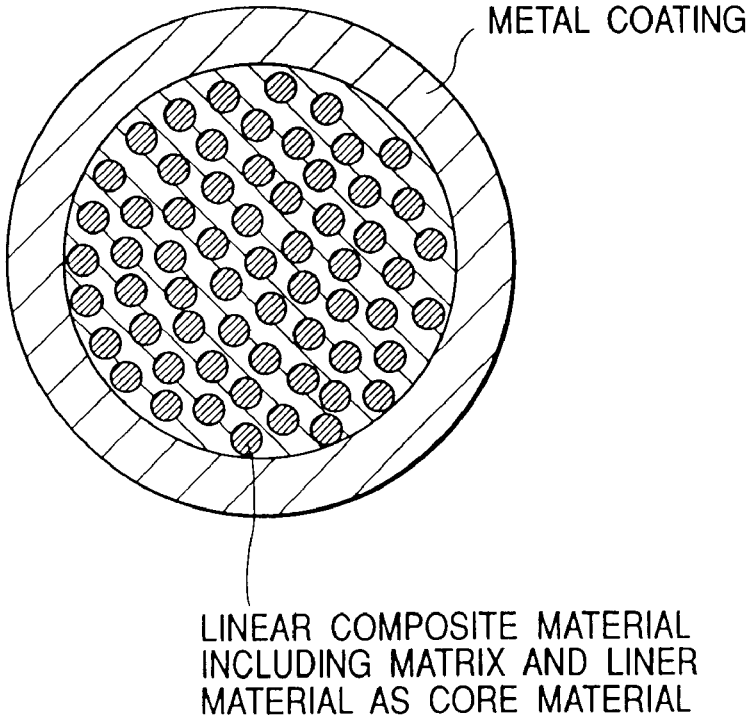
Figure 3B:
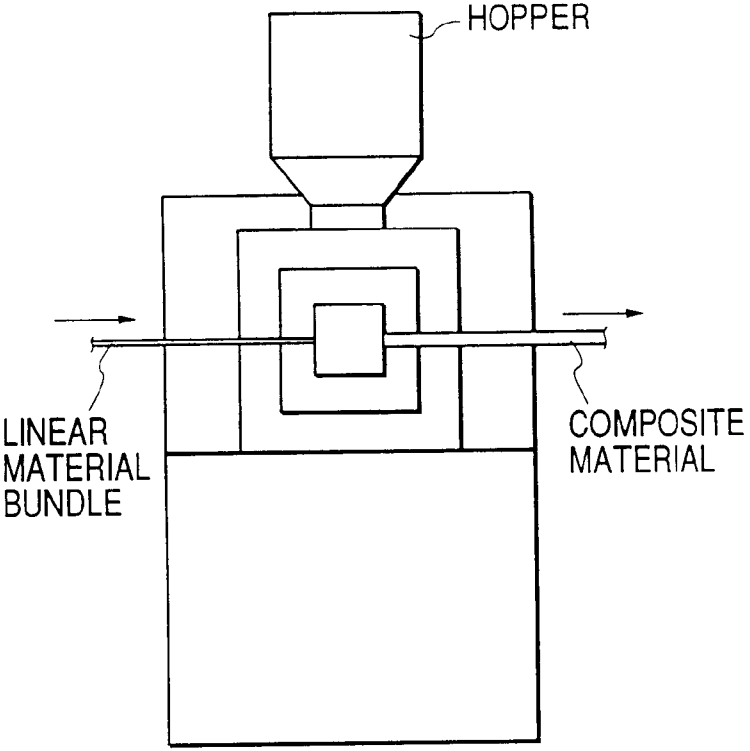
FIG. 3(b) PRIOR ART
FIG. 3 is a diagram showing a conventional extruder for use to manufacture, for example, an electric fiber, in which FIG. 3(*a*) is a side view and FIG. 3(*b*) is a front view.
Figure 3A:
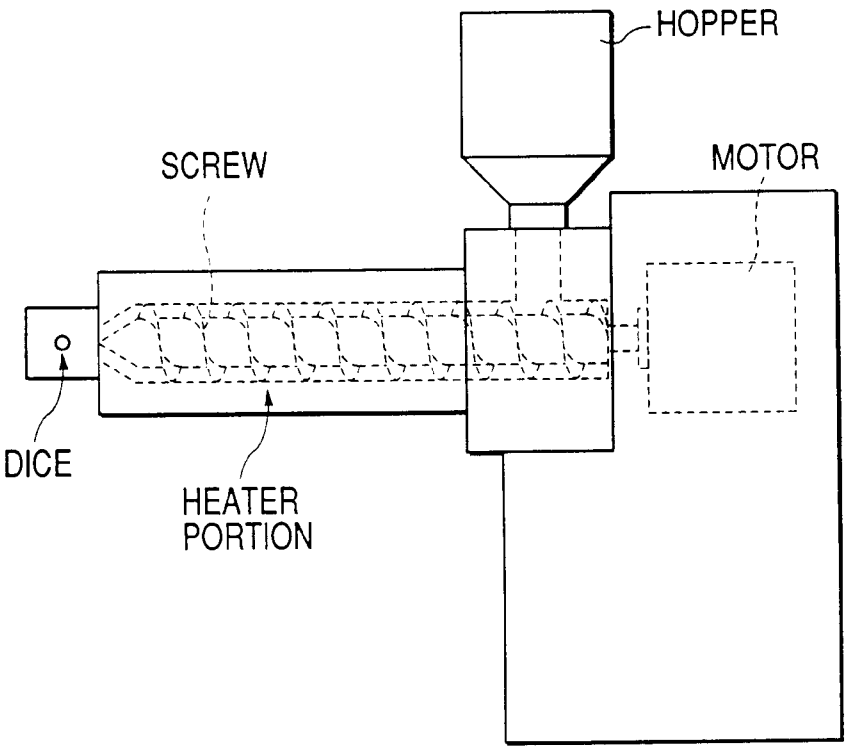
FIG. 3(a) PRIOR ART
Figure 4:
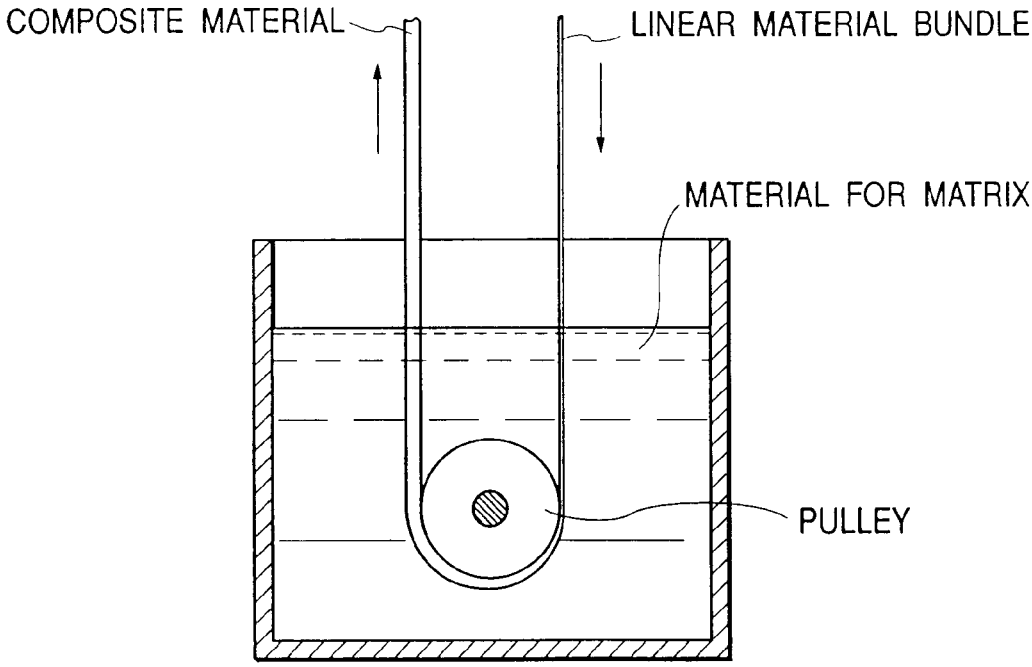
FIG. 4 PRIOR ART
FIG. 4 is a diagram showing a model of a conventional method of manufacturing a composite material.

FIGS. 2(*a*) and 2(*b*) are cross sectional views showing a model of the linear composite material obtained by the method of manufacturing the composite material by the melting and impregnating method according to the present invention.

FIG. 2(*a*) is a cross sectional view showing a model of the linear composite material composed of a matrix, which is not coated with the metal coating, and a linear material. FIG. 2(*b*) is a cross sectional view showing a model of a linear composite material composed of a matrix having the surface coated with the metal coating and the linear material which is the core material.

According to the present invention, an excellent linear composite material free from any defect, such as a void, can be obtained in which the matrix is contained in an optimum quantity.

When the linear composite material which can be obtained as described above and which incorporates the matrix, which is metal, and the linear material is made of high-strength fibers, such as ceramic fibers or carbon fibers, the foregoing linear composite material may be used as the center material of a twisted conductor for an electric fiber. In the foregoing case, a high-strength and light-weight electric fiber can be obtained.

The apparatus for manufacturing the linear composite material according to the present invention enables an excellent linear composite material which is free from any defect, such as a void, and which has performance similar to the theoretical performance can be obtained with satisfactory productivity.

What is claimed is:

1. A method of manufacturing a linear composite material comprising the steps of:

continuously introducing a linear material serving as a core material through an inlet sealing portion formed in the bottom portion of an impregnating tank containing a molten material for a matrix;

pressurizing said molten material inside said tank by supplying a pressurized gas inside said tank;

drawing said linear material impregnated with said material for the matrix in a drawing portion, which is formed adjacent to the liquid level of said molten material for the matrix, and which is housed in the impregnation tank; and continuously extracting said linear material impregnated with said material for the matrix through an outlet sealing portion formed in said impregnating tank, wherein the surface of said linear composite material is coated with metal by a metal coating device disposed in contact with said outlet sealing portion of said impregnating tank.

2. A method of manufacturing a linear composite material comprising the steps of:

supplying a molten material from a raw material heating tank through a heating passage, which communicates with an impregnating tank such that the molten material is continuously supplied to the impregnating tank;

continuously introducing a linear material serving as a core material through an inlet sealing portion formed in the bottom portion of said impregnating tank containing said molten material for a matrix;

pressurizing said molten material inside said impregnating tank;

drawing said linear material impregnated with said molten material for the matrix in a drawing portion, which is formed adjacent to the liquid level of said molten material for the matrix, and which is housed in the impregnation tank; and continuously extracting said linear material impregnated with said molten material for the matrix through an outlet sealing portion formed in said impregnating tank; wherein the surface of said linear material is coated with metal by a metal coating device disposed in contact with said outlet sealing portion of said impregnating tank.

* * * * *